United States Patent [19]

Nagai et al.

[11] Patent Number: 4,489,014

[45] Date of Patent: Dec. 18, 1984

[54] VARIABLE VENTURI CARBURETOR

[75] Inventors: Tadashi Nagai; Eiichi Ohnishi; Giichi Shioyama; Yutaka Matayoshi, all of Yokosuka, Japan

[73] Assignee: Nissan Motor Company, Limited, Japan

[21] Appl. No.: 540,627

[22] Filed: Oct. 11, 1983

[51] Int. Cl.[3] ..... F02M 9/06

[52] U.S. Cl. ..... 261/44 C

[58] Field of Search ..... 261/44 C, 44 B

[56] References Cited

U.S. PATENT DOCUMENTS

| | | | |
|---|---|---|---|
| Re. 31,475 | 12/1983 | Edmonston | 261/44 B |
| 2,062,496 | 12/1936 | Brokel | 261/44 B |
| 4,013,741 | 3/1977 | Edmonston | 261/44 B |
| 4,185,054 | 1/1980 | Nakamura et al. | 261/44 C |
| 4,264,537 | 4/1981 | Watanabe et al. | 261/44 C |
| 4,302,404 | 11/1981 | Nakamura et al. | 261/44 C |
| 4,305,893 | 12/1981 | Morino | 261/44 C |

FOREIGN PATENT DOCUMENTS

| | | | |
|---|---|---|---|
| 1537491 | 12/1978 | United Kingdom | 261/44 C |
| 2112864 | 7/1983 | United Kingdom | 261/44 C |

*Primary Examiner*—Tim Miles

*Attorney, Agent, or Firm*—Leydig, Voit, Osann, Mayer and Holt Ltd.

[57] ABSTRACT

In a prior-art variable venturi carburetor in which the cross-sectional area of venturi is automatically varied according to the amount of intake air to keep the flow rate of intake air or the vacuum generated at the venturi at a constant level, since the cross section of venturi changes rectangularly, fuel is concentratedly jetted only near the middle portion of the venturi, so that fuel is not uniformly mixed with air passing through the venturi. To overcome these drawbacks, a wall having a reverse trapezoidal recess is provided near the nozzle and further a pair of triangular slots or cutouts are formed near the lower end surface of the suction piston obliquely and symmetrically so as to slidably engage with the wall, with the result that the cross section of the venturi changes trapezoidally and therefore a stable mixture is obtained even when the engine is running at a low speed or being idled.

7 Claims, 13 Drawing Figures

VARIABLE VENTURI CARBURETOR

BACKGROUND OF THE INVENTION

1. Field of the Invention

The present invention relates generally to a variable venturi carburetor for an engine in which the cross-sectional area of venturi portion automatically changes according to the amount of intake air to keep the flow rate of intake air, that is, the vacuum generated at the venturi portion at a constant level, regardless of the amount of intake air, the carburetor of this type being called a constant vacuum carburetor. Further, in the carburetor of this type, the metering jet portion of fuel also automatically changes according to the amount of intake air to keep the mixture at a constant air-to-fuel ratio at all times. The present invention relates specifically to a variable venturi carburetor of constant vacuum type in which a stable, uniform mixture can be obtained throughout the venturi portion even when the cross-sectional area of venturi is relatively small, that is, when the engine is running at a low speed or being idled.

2. Description of the Prior Art

Variable venturi carburetors or constant vacuum carburetors are well known. The variable venturi carburetor is usually attached to an intake passage on the upstream side from a throttle valve. The venturi thereof is formed between a fixed venturi portion and a movable venturi portion. The fixed venturi portion includes a nozzle body having a nozzle at one end portion thereof, the nozzle body being connected to a float chamber to supply fuel from the float chamber to the intake passage. The movable venturi portion includes a suction cylinder, a suction piston the inner space of which is partitioned into an atmospheric pressure chamber and a vacuum chamber, and a suction spring.

The suction piston serving as the movable venturi portion moves to or away from the fixed venturi portion, in dependence upon the force balance determined by pressure difference between the atmospheric pressure chamber and vacuum chamber, the urging force of the suction spring, and the weight of the suction piston, so that the cross-sectional area of the venturi changes according to the amount of intake air to keep vacuum at a constant level at the venturi portion. Further, at the center of the lower end surface of the suction piston, a tapered jet needle is fixed so as to pass through a central hole formed in the needle body. Therefore, when the suction piston moves to or away from the fixed venturi portion, the metering jet portion formed between the jet needle and the nozzle portion of the nozzle body varies to keep the mixture obtained at the venturi portion at a constant air-to-fuel ratio.

In the prior-art variable venturi carburetor as described above, however, since the venturi portion is formed by two oppositely arranged flat surfaces, that is, by the lower flat end surface of the suction piston and the upper flat surface of the fixed venturi portion, in the case where the amount of intake air is small and therefore the movable venturi portion closely approaches the fixed venturi portion, the cross section of the venturi portion becomes a slender rectangle in shape within the intake passage. Therefore, when fuel is jetted from the nozzle portion to the venturi, since fuel tends to concentrate to the middle portion of the rectangular venturi portion, fuel is not uniformly mixed with the air passing through the venturi therethroughout in particular on both the sides of the venturi remote from the nozzle portion. Therefore, there exists a problem in that the mixture is not uniform or the air-to-fuel ratio is uneven and therefore the engine is not driven stably especially when the amount of intake air is small or when the engine is running at a low speed or being idled.

A more detailed description of the prior-art variable venturi carburetor will be made with reference to the attached drawings under

DETAILED DESCRIPTION OF THE PREFERRED EMBODIMENTS

SUMMARY OF THE INVENTION

With these problems in mind, therefore, it is the primary object of the present invention to provide a variable venturi carburetor in which the fuel jetted from the nozzle to the venturi portion can be uniformly mixed with the air passing through the venturi portion, even when the amount of intake air is small and therefore the movable venturi portion closely approaches the fixed venturi portion, in order to supply a stable mixture to the engine when the engine is running at a low speed or being idled.

To achieve the above-mentioned object, the variable venturi carburetor according to the present invention comprises, in particular, a wall member disposed at the nozzle portion extending perpendicularly to the longitudinal axis of the intake air and formed with a recess obliquely and symmetrically cut off widening in the upward direction from the nozzle portion (e.g. a reverse trapezoidal recess) and a suction piston formed with a pair of recesses also obliquely and symmetrically cut off from the outer periphery thereof to the lower end surface thereof on either side widening in the downward direction to the nozzle portion (e.g. triangular slots or cutouts), in such a way that the wall can slidably engage with the slots or cutouts, in addition to the conventional variable venturi carburetor including a fixed venturi portion formed at the inner wall surface of the intake pipe, a nozzle body arranged at the fixed venturi portion, a tapered jet needle fixed at the center of the lower end surface of the suction piston so as to pass through the nozzle portion, etc.

By the aid of the above-mentioned wall member disposed at the fixed venturi portion and the suction piston serving as the movable venturi portion, the cross-sectional area of the venturi portion can be increased gradually in the vertical and horizontal directions on the cross section of the intake passage beginning from the nozzle portion, according to the stroke of the suction piston, in order to collect fuel and air near the nozzle portion and thereby to mix fuel and air uniformly throughout the venturi.

BRIEF DESCRIPTION OF THE DRAWINGS

The features and advantages of the variable venturi carburetor according to the present invention over the prior-art variable venturi carburetor will be more clearly appreciated from the following description of the preferred embodiments of the invention taken in conjunction with the accompanying drawings in which like reference numerals designate the same or similar elements or sections throughout the figures thereof and in which:

FIG. 7(*b*) is a fragmentary side view showing the lower end portion of the suction piston having a pair of triangular slots shown in FIG. 7(*a*);

FIG. 7(*c*) is a fragmentary front view showing the lower end portion of the suction piston having a pair of triangular slots shown in FIG. 7(*a*);

FIG. 7(*d*) is a bottom view showing the suction piston having a pair of triangular slots shown in FIG. 7(*a*);

FIG. 8(*b*) is a fragmentary front view showing the lower end portion of the suction piston having a pair of triangular cutouts shown in FIG. 8(*a*); and FIG. 8(*c*) is a bottom view showing the suction piston having a pair of triangular cutouts shown in FIG. 8(*a*).

DETAILED DESCRIPTION OF THE PREFERRED EMBODIMENTS

Generally, a variable venturi carburetor is called a constant vacuum carburetor in which the cross-sectional area of venturi is automatically adjusted according to the amount of intake air in order to maintain the air flow rate or the vacuum at the venturi portion at a constant level, and further the metering jet area formed between a jet needle and a nozzle is also automatically adjusted according to the variation in venturi cross-sectional area in order to supply the mixture of a constant air-to-fuel ratio into the engine at all times.

To facilitate understanding of the present invention, a reference will be made hereinbelow to a prior-art variable venturi carburetor for an engine, with reference to the attached drawings.

Figure 1:
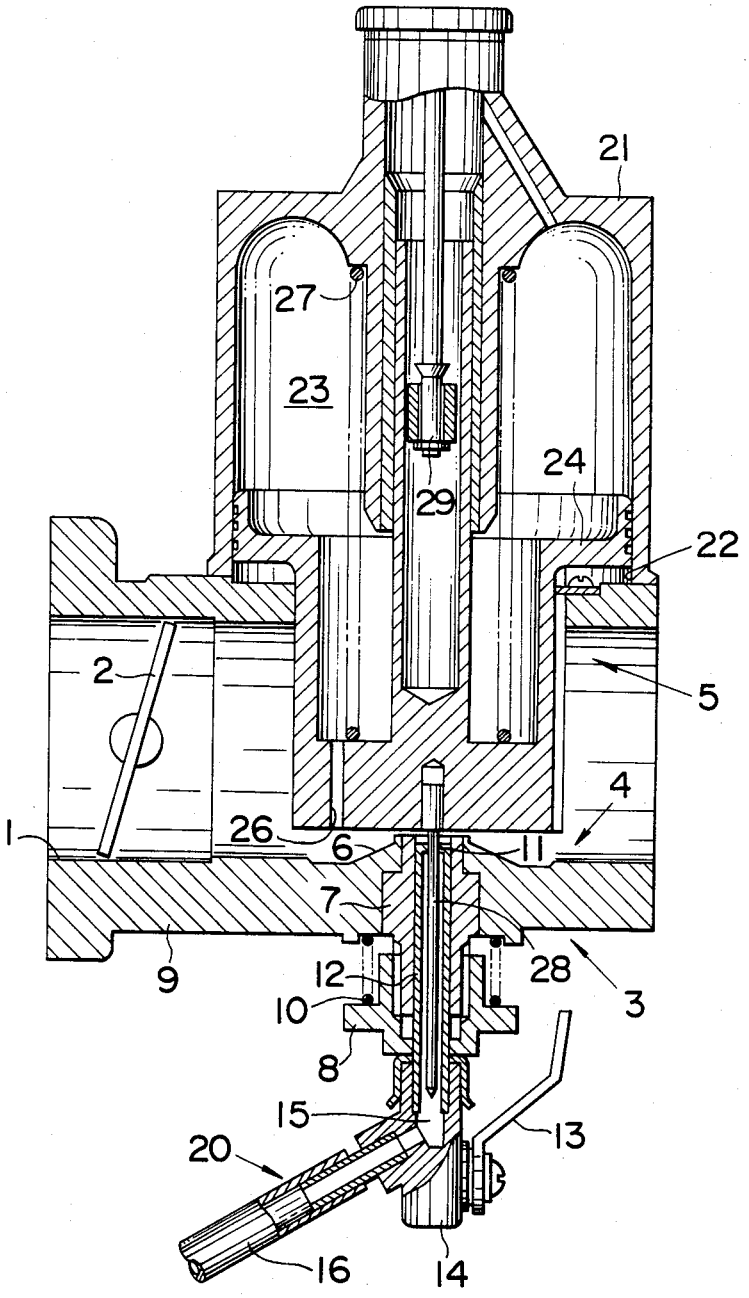
FIG.1 (PRIOR ART)
FIG. 1 is a cross-sectional front view showing an example of prior-art variable venturi carburetors for engines.
Figure 2:
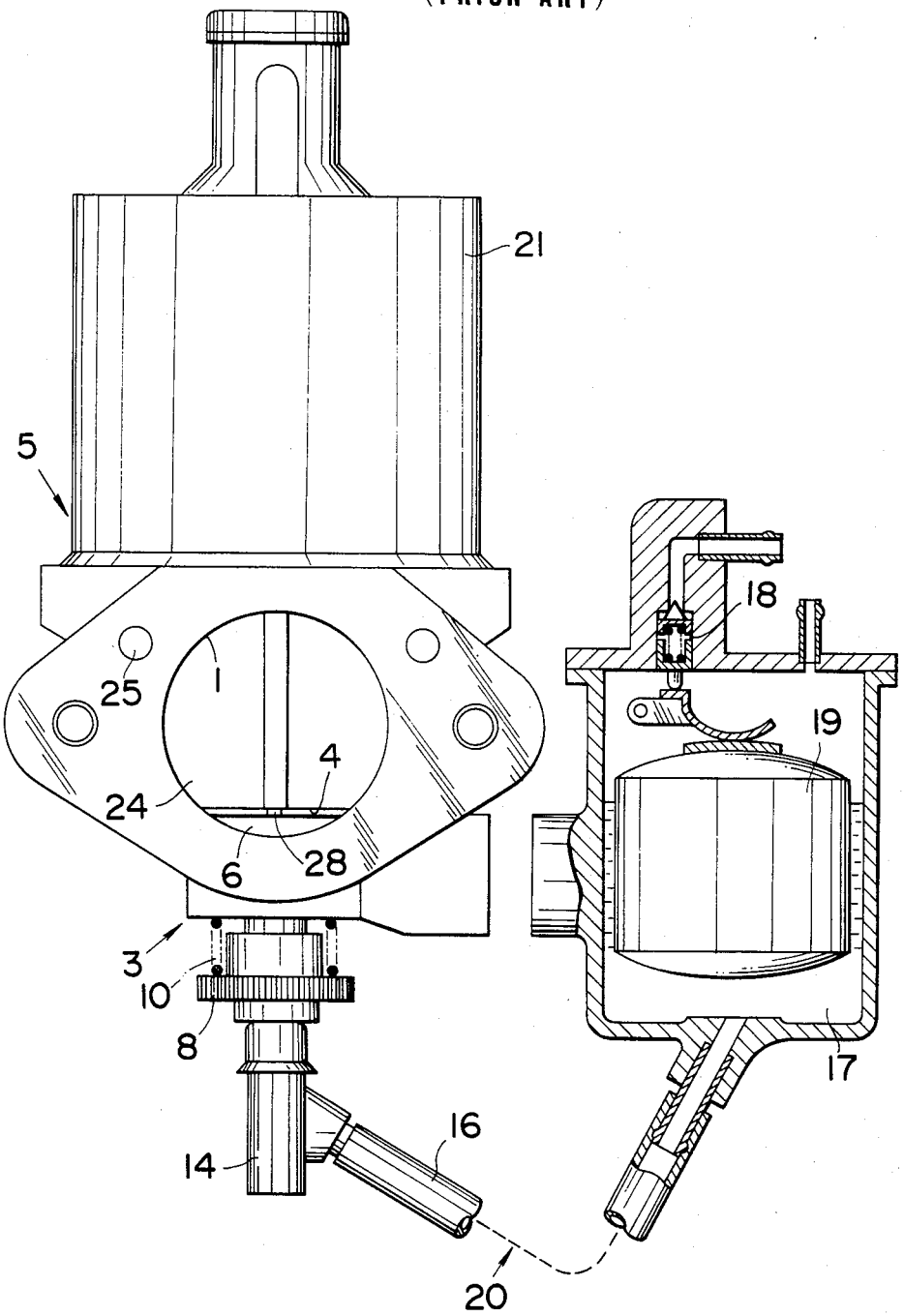
FIG.2 (PRIOR ART)
FIG. 2 is a side view showing the prior-art variable venturi carburetor for an engine shown in FIG. 1, including a cross-sectional view showing a float chamber.
Figure 3:
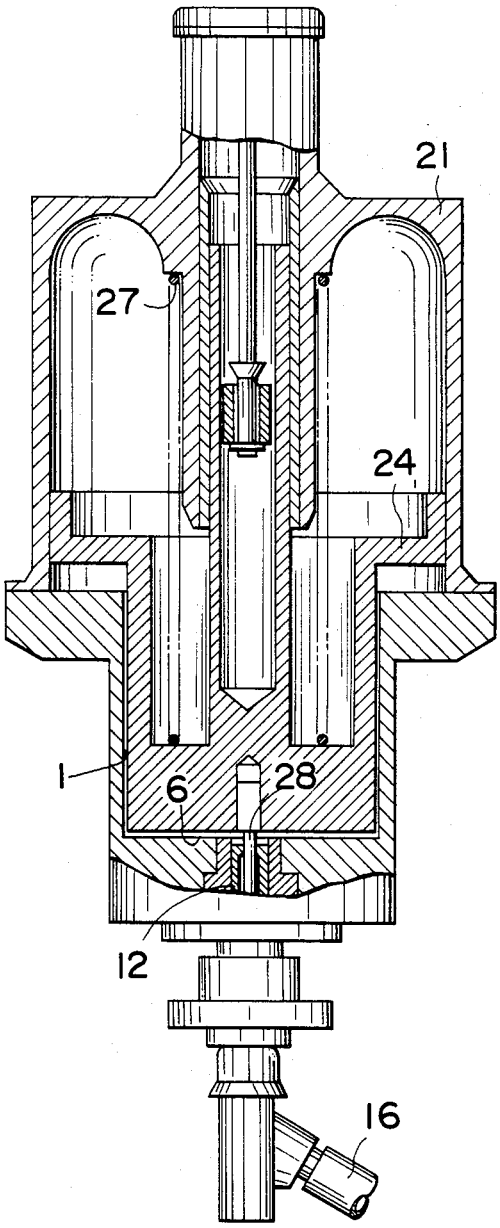
FIG.3 (PRIOR ART)
FIG. 3 is a cross-sectional side view showing the prior-art variable venturi carburetor for an engine shown in FIG. 1.

FIGS. 1, 2 and 3 show an example of prior-art variable venturi carburetors, which is described in a book titled "Theory and Practice of Carburetors" by Takashi Yoshida, published from TETSUDO NIPPON-SHA. In the drawings, the variable venturi carburetor is attached to an intake passage 1 on the upstream side from a throttle valve 2 connected to an accelerator pedal (not shown). The venturi portion 4 is formed between a fixed venturi portion 3 and a movable venturi portion 5. The fixed venturi portion 3 includes a projection 6 projecting inwardly from the inner wall of the intake passage 1 and extending in flat state when seen through the intake passage 1, as depicted in FIG. 2. A nozzle guide 7 is fitted to a hole formed at the center of this projection 6. To the end portion of the nozzle guide 7, an idle adjusting nut 8 is screw-fitted. A spring 10 is disposed in compression mode between the idle adjust nut 8 and an intake pipe 9. Into the nozzle guide 7, a nozzle body 12 having a nozzle portion 11 at one end portion thereof is slidably inserted. To the other end portion of the nozzle body 12, a connector 14 having a lever 13 is screw-fitted. When this lever 13 is moved automatically or manually at engine start, the nozzle body 12 is moved in the downward direction to increase the metering jet area formed at the nozzle 11. Further, this connector 14 is urged in the upward direction by a spring (not shown). Within the nozzle body 12, a fuel passage 15 is formed communicating with the nozzle 11.

With reference to FIG. 2, therefore, fuel is supplied from a float chamber 17 to the intake passage 1 via a fuel pipe 16. On the other hand, fuel is supplied from a fuel tank (not shown) to the float chamber 17 via a needle valve 18. A float 19 is moved up and down according to the amount of fuel within the float chamber 17 in order to open or close the needle valve 18, with the result that the amount of fuel within the float chamber 17 is kept at a constant level at all times and therefore a constant amount of fuel is fed from the float chamber 17 to the nozzle body 12. In this connection, the reference number 20 denotes a fuel passage from tne float chamber 17 to the nozzle body 12, which is made up of the fuel pipe 16, the connector 14 and the fuel passage 15.

With reference to FIG. 1 again, the movable venturi portion 5 is made up of a suction cylinder 21 disposed on the opposite side of the fixed venturi portion 3 and a suction piston 24 slidably fitted to the suction cylinder 21 so as to partition the inside of the suction cylinder 21 into an atmospheric pressure chamber 22 and a vacuum chamber 23. Further, the venturi portion 4 is formed between the bottom surface of the suction piston 24 (the movable venturi portion 5) and the fixed venturi portion 3. Atmospheric pressure is introduced into the atmospheric pressure chamber 22 through atmosphere holes 25 (shown in FIG. 2) and venturi vacuum on the downstream side from the venturi portion 4 is introduced into the vacuum chamber 23 through a suction hole 26 formed in the suction piston 24 (shown in FIG. 1). The suction piston 24 is urged toward the fixed venturi portion 3 by a suction spring 27 disposed in compression mode within the vacuum chamber 23. As a result, the suction piston 24 moves to or away from the fixed venturi portion 3 in dependence upon the force balance determined by the difference in pressure between the atmospheric pressure chamber 22 and the vacuum chamber 23, the urging force of the suction spring 27 and the weight of the suction piston 24 itself. At the center of the bottom end of this suction piston 24, a tapered jet needle 28 is fixed passing through the nozzle portion 11 formed at the top end of the needle body 12. Therefore, an annular metering jet portion 11 is formed between the tapered jet needle 28 and the nozzle portion 11 of the nozzle body 12. The area of this annular metering jet 11 increases when the suction piston 24 moves away from the fixed venturi portion 3 and decreases when the suction piston 24 moves to the fixed venturi portion 3. Further, the reference numeral 29 shown in FIG. 1 denotes an oil damper for preventing the suction piston 24 from being vibrated due to pulsation of intake pressure.

In the variable venturi carburetor as described above, the suction piston 24 is moved to or away from the fixed venturi portion 3 in dependence upon the vacuum generated at the venturi portion 4, that is, the amount of intake air; as a result, the area of the metering jet 11 varies according to the stroke of the suction piston 24. In more detail, when the throttle valve 2 is fully opened, the amount of intake air increases, so that a great vacuum is generated at the venturi portion 4. As a result, this vacuum is introduced into the vacuum chamber 23 through the suction hole 26 to the upper side of the suction piston 24, so that the suction piston 24 is moved upward away from the fixed venturi portion 3 to increase the cross-sectional area of the venturi portion 4. Therefore, the area of the annular metering jet portion increases, so that a greater amount of fuel corresponding to the greater amount of intake air is jetted into the intake passage 1 through the metering jet 11 in order to keep a constant air-to-fuel ratio.

On the other hand, when the throttle valve 2 is opened a little, since the amount of intake air is small, the vacuum generated at the venturi portion 4 is not great. Therefore, the suction piston 24 is moved in the downward direction to decrease the cross-sectional area of the venturi portion 4. Therefore, the area of the annular metering jet portion decreases, so that a smaller amount of fuel corresponding to the smaller amount of intake air is jetted into the intake passage 1 through the metering jet 11 in order to keep a constant air-to-fuel ratio. As the variable venturi carburetor is called a constant vacuum carburetor, the vacuum or the air flow rate at the venturi portion 4 is kept roughly at a constant level regardless of the amount of intake air. This is because the cross-sectional area of venturi varies roughly in proportion to the amount of intake air. Additionally, the air-to-fuel ratio is kept at a constant level regardless of the amount of intake air. This is because the area of the metering jet varies roughly in proportion to the amount of intake air.

In the prior-art variable venturi carburetor described above, however, since the venturi portion 4 is formed by two oppositely arranged flat surfaces, that is, by the lower end surface of the suction piston 24 and the flat projection 6 of the fixed venturi portion 3, in the case where the amount of intake air is small and therefore the movable venturi portion 5 closely approaches the fixed venturi portion 3 as depicted in FIG. 3, the cross-sectional area of the venturi portion 4 becomes a slender rectangle in shape within the intake passage 1. Therefore, when fuel is jetted from a nozzle portion 11 located at the middle of the above-mentioned rectangular venturi portion 4, although fuel is well mixed with air near the nozzle portion 11, that is, at the middle of the venturi portion 4, fuel is not well mixed with air at positions far away from the nozzle portion 11, that is, on both the extreme ends of the venturi portion 4. As a result, the mixture is not uniform or the air-to-fuel ratio is not even throughout the venturi portion 4, thus raising a problem in that it is impossible to drive the engine stably when the amount of intake air is small, that is, when the engine is running at a low speed or being idled.

In view of the above description, reference is now made to the embodiments of the variable venturi carburetor for an engine according to the present invention.

The feature of the present invention is to widen the cross-sectional area of venturi portion trapezoidally, in other words, gradually in the vertical and horizontal directions on the cross section of the intake passage, according to the stroke of the suction piston, without widening the area rectangularly or abruptly only in the vertical direction as in the conventional variable venturi carburetor.

FIGS. 4, 5, 6 and 7 show a first embodiment of the present invention. The variable venturi carburetor attached to an intake passage 1 is made up roughly of a fixed venturi portion 3 and a movable venturi portion 5. The fixed venturi portion 3 includes a projection 6, a nozzle guide 7, an idle adjusting nut 8, a spring 10, a nozzle body 12, etc., as in the prior-art variable venturi carburetor shown in FIGS. 1, 2 and 3.

The movable venturi portion 5 includes a suction cylinder 21, a suction piston 24, a suction spring 27, etc., also as in the prior-art variable venturi carburetor shown in FIGS. 1, 2 and 3. Further, although not shown in FIG. 4, a tapered jet needle 28 is fixed to the suction piston 24 at the center of the lower end surface thereof, the one end of which is passed through the central hole of the nozzle body 12.

Figure 4:
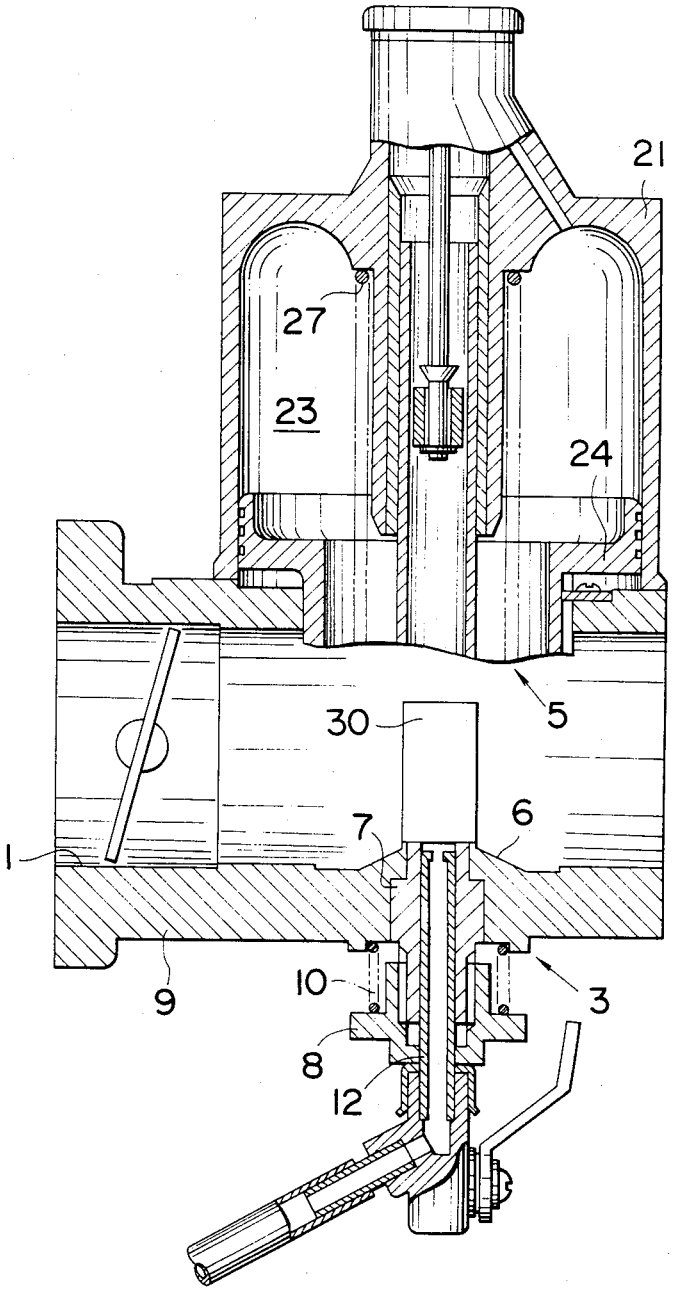
FIG. 4 is a cross-sectional front view showing the variable venturi carburetor for an engine according to the present invention.
Figure 5:
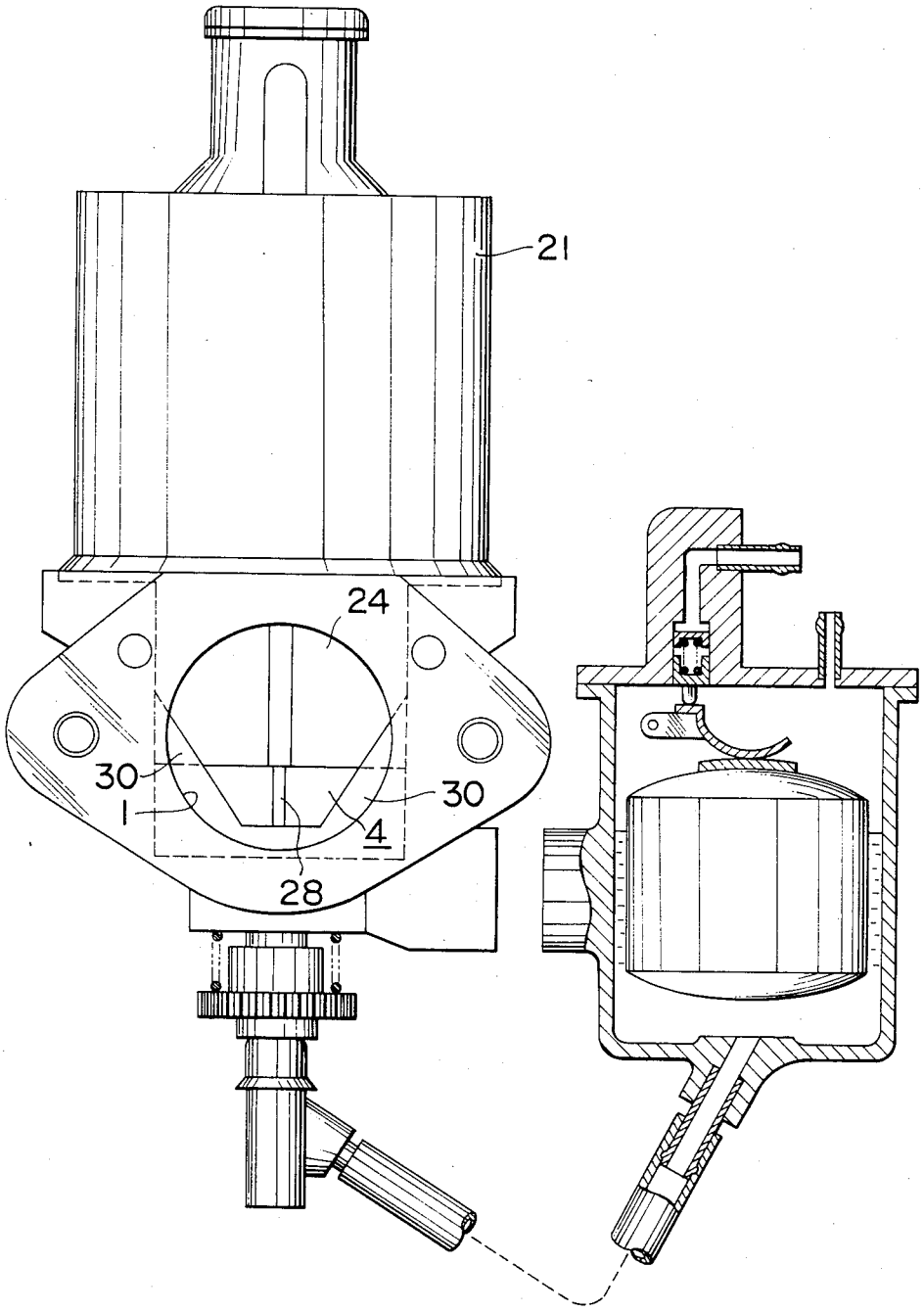
FIG. 5 is a side view showing the variable venturi carburetor for an engine according to the present invention shown in FIG. 4, including a cross-sectional view showing a float chamber.
Figure 6:
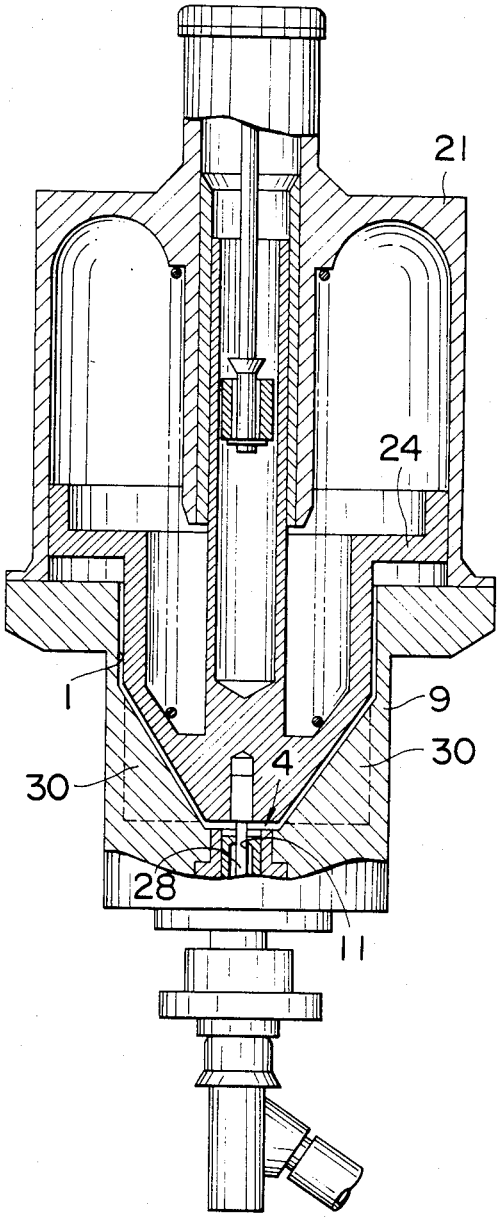
FIG. 6 is a cross-sectional side view showing the variable venturi carburetor for an engine according to the present invention shown in FIG. 4.

Being different from the prior-art variable venturi carburetor shown in FIGS. 1 to 3, in the carburetor according to the present invention, a wall 30 having a reverse trapezoidal recess is provided at the nozzle portion extending perpendicularly to the longitudinal axis of the intake pipe 9. In the reverse trapezoidal recess, the recess is cut off obliquely and symmetrically widening in the upward direction from the nozzle portion. This wall 30 is formed independently from or integrally with the inner wall of the intake pipe 9, as depicted in FIGS. 4 and 6, in such a way as to function as a weir against the air flowing through the intake passage.

Figure 7:
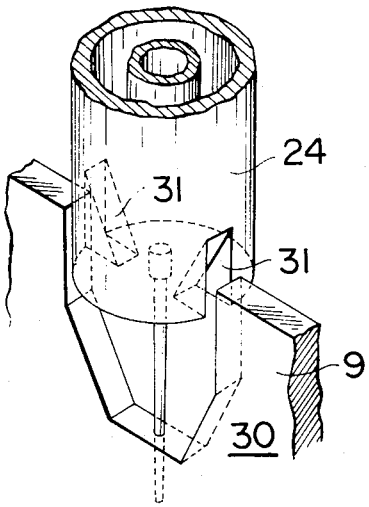
FIG. 7(*a*) is a perspective views for assistance in understanding the mutual engagement relationship between the wall having a trapezoidal recess at the middle portion thereof and the lower end portion of the suction piston having a pair of triangular slots, the wall and the suction piston being described as a first embodiment of the variable venturi carburetor according to the present invention.
Figure 7:
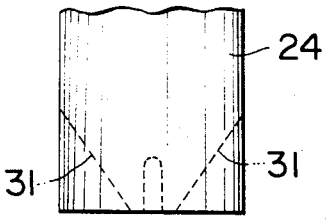
Figure 7:
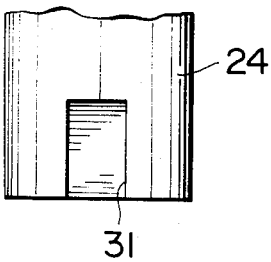
Figure 7:
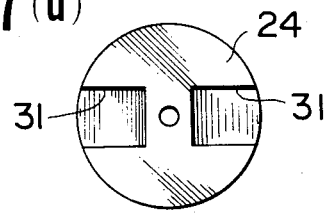

On the other hand, the suction piston is formed at the lower end thereof with a pair of triangular slots 31 obliquely and symmetrically cut off from the outer periphery of the suction piston to the lower end surface thereof on either side thereof widening in the downward direction to the nozzle portion. These two triangular slots 31 are engaged with the wall 30 having a reverse trapezoidal recess, so that when the suction piston 24 moves up and down, these two triangular slots 31 slides along and in contact with the wall 30 having a reverse trapezoidal recess. In this connection, FIG. 7(*a*) shows perspectively the mutual engagement relationship between the wall 30 and the suction piston 24. Further, FIG. 7(*b*) is a side view of the lower end portion of the suction piston 24 as in FIGS. 5 or 6; FIG. 7(*c*) is a front view thereof as in FIG. 4; and FIG. 7(*d*) is a bottom view thereof.

Therefore, when the suction piston 24 moves up and down with the two triangular slots 31 engaged with the wall 30 having a reverse trapezoidal recess, a reverse trapezoidal cross-sectional area can be variably formed within the intake passage 1 as a venturi portion. Here, it should be noted that since the trapezoidally recessed wall 30 is engaged with the two triangular slots 31, it is possible to trapezoidally vary the venturi passage area formed between the lower end portion of the movable suction piston 24 and the fixed venturi portion 3. In other words, when a suction piston 24 having a trapezoidal end surface is moved to or away from the trapezoidally recessed wall 30, since a clearance is formed on both the sides of the suction piston 24, it is impossible to vary the venturi area trapezoidally. However, without being limited to the structure as described with reference to FIGS. 4 to 7, it is of course possible to increase the cross-sectional area of venturi gradually in the vertical and horizontal directions on the cross section of the intake passage according to the stroke of the suction piston 24, by forming a pair of cutouts on both the sides of the suction piston 24 or by simply providing additional shutter members.

The operation of the variable venturi carburetor according to the present invention will be described hereinbelow. When the engine starts running, vacuum is generated at the venturi portion 4 formed between the fixed venturi portion 3 and the movable venturi portion 5. Therefore, the vacuum is introduced into the vacuum chamber 23 through the suction hole 26, so that the suction piston 24 moves in the upward direction. In the case where the engine is running at a relatively slow speed or being idled, since the amount of intake air is small (low air-flow rate region), the vacuum generated at the venturi portion is relatively low, the suction piston 24 closely approaches the fixed venturi portion 3 and therefore the width of the venturi cross-sectional area is small, as depicted in FIG. 6. Accordingly, intake air flows through the venturi portion 4 only near the nozzle portion 11. As a result, the fuel jetted from the annular metering jet portion 11 to the venturi portion 4 due to the vacuum generated thereat is uniformly mixed with the intake air collected near the nozzle portion 11. That is to say, a mixture with a stable air-to-fuel ratio can be supplied to the engine and the engine can be driven stably in a low air-flow rate region.

On the other hand, in the case where the engine is running at a relatively high speed, since the amount of intake air increases (high air-flow rate region), the vacuum generated at the venturi portion is relatively high, the suction piston 24 moves in the upward direction away from the fixed venturi portion 3 and therefore the venturi cross-sectional area increases. In this case, the suction piston 24 moves upward with the two triangular slots 31 sliding along the wall 30 having a reverse trapezoidal recess fixed at the venturi portion 4. Therefore, the cross-sectional area of the venturi portion increases gradually in the vertical and horizontal direction, when seen in FIGS. 5 or 6, as the suction piston 24 moves in the upward direction. In more detail, although in the prior-art variable venturi carburetor, the cross-sectional area of the venturi increases rectangularly, in this carburetor according to the present invention, the cross-sectional area thereof increases trapezoidally. As a result, it is possible to collect intake air relatively near the nozzle portion 11, so that the fuel jetted into the venturi portion through the nozzle is uniformly mixed with the intake air passing through the venturi portion.

In addition to the above-mentioned advantage, since the cross-sectional area of the venturi portion is formed in reverse trapezoidal shape, the suction piston 24 moves farther away from the fixed venturi portion 3, as compared with the case of the prior-art carburetor in which the cross-sectional area is formed in the rectangular shape, in order to increase the same amount of venturi area, that is, to increase the same amount of intake air. In other words, the stroke of the suction piston must be moved up and down relatively greatly when the same amount of intake air changes. This results in an additional feature such that it is possible to enhance the accuracy of the amount of fuel jetted through the nozzle 11, that is, the accuracy of air-to-fuel ratio. This is because it is possible to design the taper rate of the jet needle 28 more gently and therefore to change the area of the metering jet portion more accurately.

Figure 8:
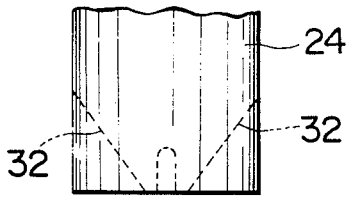
FIG. 8(*a*) is a fragmentary side view showing the lower end portion of the suction piston having a pair of triangular cutouts, which is described as a second embodiment of the variable venturi carburetor according to the present invention.
Figure 8:
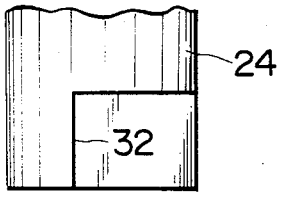
Figure 8:
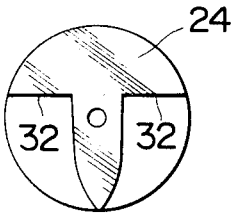

FIGS. 8(*a*) to 8(*c*) show a second embodiment of the present invention, in which only the lower end portion of the suction piston 24 is depicted. In comparison with the case shown in FIGS. 7(*a*) to 7(*d*), in this embodiment, a pair of triangular cutout portions 32 are formed in place of two triangular slots 31 near lower end portion of the suction piston 24 also in such a way as to engage with the trapezoidally recessed wall 30. Similarly, FIG. 8(*a*) is a side view of the lower end portion of suction piston 24 as in FIG. 7(*b*); FIG. 8(*b*) is a front view thereof as in FIG. 7(*c*); and FIG. 8(*c*) is a bottom view thereof. As understood in FIGS. 8(*a*) to 8(*c*), these two cutouts 32 are formed by increasing the width of slots 31 to the extreme end of the outer periphery of the suction piston 24 only on the downstream side from the venturi portion. Further, two cutout portions 32 are joined at an outer periphery of the suction piston 24 by chamferring the edges of the cutouts on the downstream side in order to decrease the bottom area of the suction piston 24 as small as possible, as depicted in FIG. 8(*c*).

In the second embodiment, since the bottom surface of the suction piston 24 is relatively small, it is possible to prevent the mixture of fuel and intake air from sticking onto the bottom surface of the suction piston 24 on the downstream side from the nozzle portion. Therefore, a more stable mixture can be supplied from the carburetor into the engine.

As described above, in the variable venturi carburetor according to the present invention which comprises the fixed venturi portion disposed on the upstream side from the throttle valve, the movable venturi portion moved to or away from the fixed venturi portion according to vacuum generated at the venturi portion, the nozzle disposed at the fixed venturi portion, a jet needle fixed to the movable venturi portion being passed through the nozzle, etc., since there are provided a wall having a reverse trapezoidal recess obliquely and symmetrically cut off widening from the nozzle portion toward the suction piston at the nozzle portion extending perpendicularly to the longitudinal axis of the intake pipe and a suction piston having a pair of triangular slots or cutouts obliquely and symmetrically cut off from the outer periphery thereof to the lower end surface thereof on either side widening in the downward direction to the nozzle portion so as to slidably engage with the wall, it is possible to increase the cross-sectional area of venturi gently in the vertical and horizontal directions on the cross section of the intake passage, that is, trapezoidally according to the stroke of the suction piston. Therefore, it is possible to collect intake air relatively near the nozzle portion, so that the fuel jetted into the venturi portion through the nozzle can be mixed uniformly with the intake air passing through the venturi portion. Therefore, a mixture with stable air-to-fuel ratio can be supplied to the engine, thus engine being driven stably, in particular when the amount of intake air is small.

Additionally, since the stroke of the suction piston increases relatively greatly when the amount of intake air changes, it is possible to enhance the accuracy of air-to-fuel ratio, because the taper portion of the jet needle can be designed more gently.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. A variable venturi carburetor attached to an intake pipe on the upstream side from a throttle valve, which comprises:

(a) a fixed venturi portion formed at the inner wall surface of the intake pipe and on the upstream side from the throttle valve;

(b) a nozzle body having a nozzle portion at the end thereof, said nozzle body being arranged at said fixed venturi portion for supplying fuel into an intake passage within the intake pipe;

(c) a suction piston serving as a movable venturi portion for forming a venturi between said fixed venturi portion and said movable venturi portion, said suction piston being moved to or away from said fixed venturi portion by the vacuum generated due to air passing through the venturi to vary the cross section of venturi for keeping the flow rate of intake air at a constant level, said suction piston being formed near the lower end thereof with a pair of first recesses obliquely and symmetrically cut off from the outer periphery of said suction piston to the lower end surface thereof on either side thereof widening to the fixed venturi portion;

(d) a tapered jet needle fixed to the lower end surface of said suction piston so as to pass through the nozzle portion formed in said nozzle body; and (e) a wall member disposed at the nozzle portion extending perpendicularly to the longitudinal axis of the intake pipe, said wall member being formed at the middle portion thereof with a second recess obliquely and symmetrically cut off widening to the movable venturi portion in such a way as to slidably engage with said two first recesses formed near the lower end of said suction piston, whereby when said suction piston moves to or away from said fixed venturi portion, the cross section of the venturi is variably defined by said wall member and said suction piston with said first recesses of said suction piston slidably engaged with said wall member, so that the cross-sectional area of the venturi increases gradually in the vertical and horizontal directions on the cross section of the intake passage beginning from near said nozzle portion in order to uniformly mix fuel from said nozzle portion with air passing through the venturi.

2. A variable venturi carburetor as set forth in claim 1, wherein said second recess formed at the middle portion of said wall member is a reverse trapezoidal recess cut off widening from the nozzle portion to said suction piston.

3. A variable venturi carburetor as set forth in claim 2, wherein said two first recesses formed near the lower end of said suction piston are two triangular slots obliquely and symmetrically cut off from the outer periphery of said suction piston to the lower end surface thereof on either side thereof widening to the nozzle portion so as to slidably engage with said wall having a reverse trapezoidal recess at the middle portion thereof.

4. A variable venturi carburetor as set forth in claim 2, wherein said two first recesses formed near the lower end of said suction piston are two triangular cutouts obliquely and symmetrically cut off from the outer periphery of said suction piston to the lower end surface thereof on either side thereof widening to the nozzle portion so as to slidably engage with said wall having a reverse trapezoidal recess at the middle portion thereof, said two cutouts being formed extending to the extreme end of the outer periphery of said suction piston on the downstream side from the nozzle portion.

5. A variable venturi carburetor as set forth in claim 4, wherein said two first triangular cutouts are joined at an outer periphery of the suction piston by chamferring the edges of the two cutouts on the downstream side from the nozzle portion to decrease the lower end surface area of said suction piston, whereby fuel jetted from said nozzle portion is prevented from sticking onto the lower end surface of said suction piston.

6. A variable venturi carburetor as set forth in claim 1, wherein said wall member is integrally formed with the inner wall of the intake pipe.

7. In a variable venturi carburetor attached to an intake pipe on the upstream side from a throttle valve, which comprises:

a fixed venturi portion formed on the inner wall surface of the intake pipe and on the upstream side from the throttle valve;

a nozzle body having a nozzle portion at the end thereof, said nozzle body being arranged at said fixed venturi portion for supplying fuel into an intake passage within the intake pipe;

a suction piston serving as a movable venturi portion for forming a venturi between said fixed venturi portion and said movable venturi portion, said suction piston being moved to or away from said fixed venturi portion by the vacuum generated due to air passing through the venturi to vary the cross section of venturi for keeping the flow rate of intake air at a constant level; and a tapered jet needle fixed to the lower end surface of said suction piston so as to pass through the nozzle portion formed in said nozzle body, the improvement which comprises;

(a) a pair of triangular slots or cutouts formed near the lower end portion of said suction piston, said triangular slots or cutouts being cut off obliquely and symmetrically from the outer periphery of said suction piston to the lower end surface thereof on either side thereof widening to said fixed portion; and (b) a wall member disposed at the nozzle portion extending perpendicularly to the longitudinal axis of the intake pipe, said wall member being formed at the middle portion thereof with a reverse trapezoidal recess obliquely and symmetrically cut off widening to the movable venturi portion in such a way as to slidably engage with said two triangular slots or cutouts formed near the lower end of said suction piston, whereby when said suction piston moves to or away from said fixed venturi portion, the cross section of the venturi is variably defined by said wall member and said suction piston with said slots or cutouts of said suction piston slidably engaged with said wall member, so that the cross-sectional area of the venturi increases gradually in the vertical and horizontal directions on the cross section of the intake passage beginning from near said nozzle portion in order to uniformly mix fuel from said nozzle portion with air passing through the venturi.

* * * * *